US010602900B2

(12) United States Patent
Koetz et al.

(10) Patent No.: US 10,602,900 B2
(45) Date of Patent: Mar. 31, 2020

(54) SELF-PROPELLED FLOOR TREATMENT DEVICE

(71) Applicant: Vorwerk & Co. Interholding GmbH, Wuppertal (DE)

(72) Inventors: Hendrik Koetz, Wetter (DE); Pia Hahn, Schwelm (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 110 days.

(21) Appl. No.: 15/883,425

(22) Filed: Jan. 30, 2018

(65) Prior Publication Data

US 2018/0213992 A1 Aug. 2, 2018

(30) Foreign Application Priority Data

Feb. 1, 2017 (DE) ..... 10 2017 101 936

(51) Int. Cl.
*A47L 9/28* (2006.01)
*A47L 9/04* (2006.01)

(52) U.S. Cl.
CPC ..... *A47L 9/2852* (2013.01); *A47L 9/0411* (2013.01); *A47L 9/2826* (2013.01); *A47L 9/2831* (2013.01); *A47L 9/2847* (2013.01); *A47L 9/0466* (2013.01); *A47L 9/0488* (2013.01); *A47L 2201/04* (2013.01); *A47L 2201/06* (2013.01)

(58) Field of Classification Search
CPC .... A47L 9/2826; A47L 9/2852; A47L 9/0411; A47L 9/2831; A47L 9/2847; A47L 2201/04; A47L 2201/06
See application file for complete search history.

(56) References Cited

U.S. PATENT DOCUMENTS

2005/0162119 A1* 7/2005 Landry ..... A47L 9/2805 318/580
2016/0235270 A1* 8/2016 Santini ..... A47L 9/0411
2018/0206686 A1* 7/2018 Shigeto ..... A47L 9/2847

* cited by examiner

*Primary Examiner* — Andrew A Horton
(74) *Attorney, Agent, or Firm* — Collard & Roe, P.C.

(57) ABSTRACT

The invention relates to a self-propelled floor treatment device (1), in particular to a cleaning robot, with a floor treatment element (2), at least two motorized wheels (3, 4) and a detection device for detecting a floor type of a surface to be treated. In order to easily achieve an optimal detection of the floor type, it is proposed that the detection device have a frictional resistance element (6), which contacts the surface during a movement in such a way that a resultant force outside of a reference axis (7) acts on the floor treatment device (1), wherein the reference axis (7) is oriented parallel to a main direction of movement (8) of the floor treatment device (1) prescribed by the orientation of the wheels (3, 4), and is aligned centrally between the wheels (3, 4) in relation to a direction perpendicular to the reference axis (7). Further proposed is a method for operating a self-propelled floor treatment device (1).

7 Claims, 3 Drawing Sheets

SELF-PROPELLED FLOOR TREATMENT DEVICE

CROSS REFERENCE TO RELATED APPLICATIONS

Applicant claims priority under 35 U.S.C. § 119 of German Application No. 10 2017 101 936.7 filed on Feb. 1, 2017, the disclosure of which is incorporated by reference.

The invention relates to a self-propelled floor treatment device, in particular to a cleaning robot, with a floor treatment element, at least two motorized wheels and a detection device for detecting a floor type of a surface to be treated.

In addition, the invention relates to a method for operating a self-propelled floor treatment device with a floor treatment element, at least two motorized wheels and a detection device for detecting a floor type of a surface to be treated.

PRIOR ART

Floor treatment devices of this type are sufficiently known in prior art. For example, these involve vacuuming or wiping robots, which can traverse a surface to be cleaned autonomously and in so doing perform cleaning tasks such as vacuuming, wiping or the like. In order to adjust the type of treatment to the respective floor type of the surface, a detection device is provided, which first determines the floor type before the treatment process. As a result, for example, specific areas of a room are precluded from treatment because the surface is not suitable. For example, it can be provided for a wiping robot that carpets be precluded from wet cleaning. In addition, the fan and brushing capacity of a vacuuming robot can be adjusted to the respective surface. In like manner, sealing lips or support rollers can be adjusted as a function of the detected floor type.

Various detection devices are known in prior art for determining the floor type. Optical measuring devices such as imaging measuring devices are often used, which utilize a camera system to record an image of the surface and compare it with reference images or reference features. The technical outlay for the camera system along with image processing for evaluating the images is correspondingly high.

Another frequent disadvantage to optical detection devices is that an optimal measuring result can only be achieved if the surface to be determined is shielded from ambient light. From this standpoint, such a detection device requires a greater equipment outlay.

SUMMARY OF THE INVENTION

Proceeding from the aforementioned prior art, it is thus the object of the invention to provide a floor treatment device with a detection device that makes it possible to reliably determine the floor type with a low outlay.

As a solution, the invention proposes a self-propelled floor treatment device in which the detection device has a frictional resistance element, which contacts the surface during a movement in such a way that a resultant force outside of a reference axis acts on the floor treatment device, wherein the reference axis is oriented parallel to a main direction of movement of the floor treatment device prescribed by the orientation of the wheels, and aligned centrally between the wheels in relation to a direction perpendicular to the reference axis.

According to the invention, the floor treatment device has a frictional resistance element, which is arranged non-symmetrically to a reference axis defined by the position of the wheels on the floor treatment device. For example, the frictional resistance element can have various distances from the wheels. The frictional resistance element is arranged on a housing of the floor treatment device in such a way that the frictional resistance element is in contact with the surface during a conventional operation of the floor treatment device, i.e., during the treatment of a surface. As a consequence, the frictional resistance exposes the frictional resistance element to a force, which because the frictional resistance is not centrally arranged relative to the wheels causes the floor treatment device to drift on the surface. If both wheels are subjected to the same force conditions, the floor treatment device travels straight ahead, i.e., it follows its main direction of movement as prescribed by the rotational plane of the wheels. However, if the floor treatment device changes from a hard floor surface having a low frictional resistance, for example, to a carpeted floor, the frictional resistance between the frictional resistance element and surface increases. As a result, an elevated frictional force acts on the frictional resistance element, with a first portion of the frictional force going to the area of the frictional resistance element situated on the one side of the reference axis, and a second portion of the frictional force acting on the area of the frictional resistance element formed on the opposite side of the reference axis. Therefore, varying levels of force act on the frictional resistance element—and hence also on the wheels—on opposing sides of the floor treatment device. This causes the area of the floor treatment device having a larger contact surface between the frictional resistance element and surface to decelerate more than the corresponding other partial area. As a result, a difference in speed comes about for the wheels driven with the same driving force, which in turn makes the floor treatment device swivel relative to the original direction of movement, i.e., the floor treatment device turns. This floor type-dependent drift ultimately makes it possible to detect the floor type of the surface on which the floor treatment device is traveling. In particular, hard floors can be differentiated from carpeted floors, short pile carpets from shag carpets and the like. Within the meaning of the invention, it is basically sufficient that the frictional resistance element provide varyingly large contact surfaces to the surface to be cleaned on both sides of the reference axis. What is important is that varyingly large resistance forces act on both sides of the frictional resistance element, thereby causing the floor treatment device to drift. However, several frictional elements can be arranged on the floor treatment device instead of a single frictional resistance element, which together have an unsymmetrical arrangement and/or formation relative to the reference axis.

It is proposed that the frictional resistance element be a treatment element for treating the surface to be treated, in particular a cleaning roller that rotates perpendicular to the reference axis. As a consequence, in addition to its actual treatment function, the treatment element that is usually already located on the floor treatment device anyway additionally serves as a frictional resistance element of the detection device for detecting a floor type. For example, the treatment element can be a rotating cleaning roller, whose circumferential surface has bristle elements or a textile cleaning cover. A partial area of the circumferential surface of the cleaning roller or generally of the frictional resistance element protrudes beyond the ground plane spanned by the wheels with the floor treatment device not standing on a surface, so that when the floor treatment device is standing on the surface, contact takes place between the frictional resistance element and the surface, for example the bristle elements or fibers of the cleaning roller engage into fibers of the surface to be cleaned. For example, this makes it possible to differentiate between a carpeted floor and a hard floor. The treatment element preferably rotates during floor treatment, wherein rotation can take place both in the rotational direction of the wheels and in the opposite direction.

However, frictional resistance elements immovably arranged on the floor treatment device are also possible. In an especially simple case, the frictional element can be a bristle row, a sealing lip or a resistance element protruding under the housing of the floor treatment device, which is used exclusively for generating a resistance force that causes the floor treatment device to drift due to the unsymmetrical effect relative to the reference axis.

It is proposed that the frictional resistance element be arranged perpendicular to the reference axis, and have a larger length on one side of the reference axis than on the opposite side of the reference axis. In an especially simple case, the frictional resistance element is a cylindrical cleaning element that can rotate around a rotational axis and crosses the reference axis. The two partial areas of the resistance element extending on different sides of the reference axis here have different lengths, and are thus subject to varying levels of force during contact with the surface to be cleaned.

It is further proposed that the floor treatment device have a controller and evaluator, which is set up to detect the floor type by comparing the speeds of the wheels at the same driving force and comparing a determined difference in speed with floor type-dependent reference differences. The resistance-dependent drift of the floor treatment device described above leads to a difference in speed for the driven wheels, since the wheel located on the side with a higher frictional resistance rotates slower than the wheel arranged on the opposite side relative to the reference axis. This difference in speed is compared with reference differences stored in the memory of the floor treatment device, which each are characteristic for a specific type of floor being traversed by the floor treatment device. For example, a difference in speed when traversing a carpeted floor is greater than a difference in speed when traversing a hard floor. If the calculated differences in speed are found to coincide with a reference difference or reference difference range, the currently traversed floor type can be inferred. When the floor type is known, a cleaning type, e.g., dry or wet, a mechanical treatment or the like can subsequently be set so that the surface can be optimally treated.

It is further proposed that the detection device have an ammeter allocated to a drive motor of the frictional resistance element, wherein a controller and evaluator of the floor treatment device is set up to compare a current received by the drive motor with floor type-dependent reference currents. The frictional resistance element can here be the same frictional resistance element, which also results in causing the floor treatment device to drift. Alternatively, however, an additional frictional resistance device can be involved. The frictional resistance element is driven by a drive motor, which takes up a defined current as a function of a floor type-dependent frictional resistance. If the current taken up by the drive motor rises while traversing a hard floor, for example, it can be inferred that the hard floor was exited, and the floor treatment device is now traversing a carpeted floor, for example. The frictional resistance element can be a side brush of the floor treatment device, for example, which is rotatably mounted. Such a side brush is usually arranged at the front of the floor treatment device relative to a main direction of movement, and is used to displace vacuumed material from room corners into a suction channel of the floor treatment device. For example, the side brush consists of several bristle tufts, which come into direct contact with the floor to be cleaned. Depending on the composition of the floor, the side brush is exposed to a varying level of friction, specifically to a relatively slight friction on a hard floor, and to a contrastingly higher friction on carpeted floors. Since the speed of the drive motor of the side brush or generally of the friction resistance element is regulated, a high friction results in an elevated current or power consumption by the drive motor. This current or power can be evaluated in relation to the floor type. The same principle also applies to other frictional resistance elements not designed as side brushes, for example to a rotating main brush of the floor treatment device. As a rule, the main brush is a brush arranged over the width of the floor treatment device that extensively treats a surface to be cleaned.

It can further be provided that the detection device have an optical reflection measuring device with a light source and a light receiver, wherein a light emission direction of the light source is essentially directed toward the ground plane spanned by the wheels. Apart from the frictional resistance element, then, the detection device can also have an optical reflection measuring device for detecting the floor type. For example, the reflection measuring device can be a distance measuring device, which predominantly serves to detect precipices. The light source of the optical reflection measuring device is preferably arranged in the front area of the floor treatment device, so as to protect a floor treatment device traveling forward in the main direction of movement against falling off of stairs or the like, for example. For example, the reflection measuring device can have an infrared light source and an infrared light receiver. The light of the light source is radiated onto the surface to be examined, there reflected, and finally hits the light receiver. Based on the reflectance of the measured surface, the floor type of the surface can be inferred, e.g., since a carpeted floor has a lower reflectance than a hard floor (tiles, wooden floorboards or the like).

Apart from the floor treatment device described above, the invention also proposes a method for operating a self-propelled floor treatment device, which has a treatment element, at least two motorized wheels and a detection device for detecting a floor type of a surface to be treated, wherein the method involves comparing the speeds of the wheels given an identical drive force so as to detect the floor type, wherein a determined difference in speed is compared with floor type-dependent reference differences. As already described above in relation to the floor treatment device, the method involves detecting a floor type of a surface to be treated based on a drift that arises due to a resistance force acting unsymmetrically on the floor treatment device. The drift is in turn caused by a difference in wheel speed, which can be measured and compared with floor type-dependent reference differences. Otherwise, the features and advantages described above in relation to the floor treatment device apply.

In particular, it is also proposed that a current received by a drive motor of a frictional resistance element be measured, wherein a current received by the drive motor is compared with floor type-dependent reference currents. In this embodiment, the method involves determining the type of surface to be cleaned not just based on a drift of the floor treatment device, but also based on a changing current or power consumption by the drive motor of the frictional resistance element that arises on different floor types.

It can further also be provided that a light source be used to direct light toward the surface to be treated, and that a light component reflected back by the surface onto a light receiver be evaluated. The type of surface can be inferred based on the reflectance of the measured surface.

Finally, it can be provided that a power of a fan of the floor treatment device and/or a speed of the floor treatment element be varied as a function of the detected floor type, and/or that information about the detected floor type be stored in a digital area map of the floor treatment device. In particular, an energy management of the floor treatment device can also be optimized as a function of the floor type of the surface to be treated, in particular in relation to a treatment duration for treating a surface, in relation to an improved cleaning performance or the like. In addition, it can also be possible to mark the exact location of detected carpets, tiles, wooden floors and the like in a digital area map, and use this information in future treatment cycles of the floor treatment device.

BRIEF DESCRIPTION OF THE DRAWINGS

The invention will be described in more detail below based on exemplary embodiments. Shown on.

DESCRIPTION OF THE EMBODIMENTS

Figure 1:
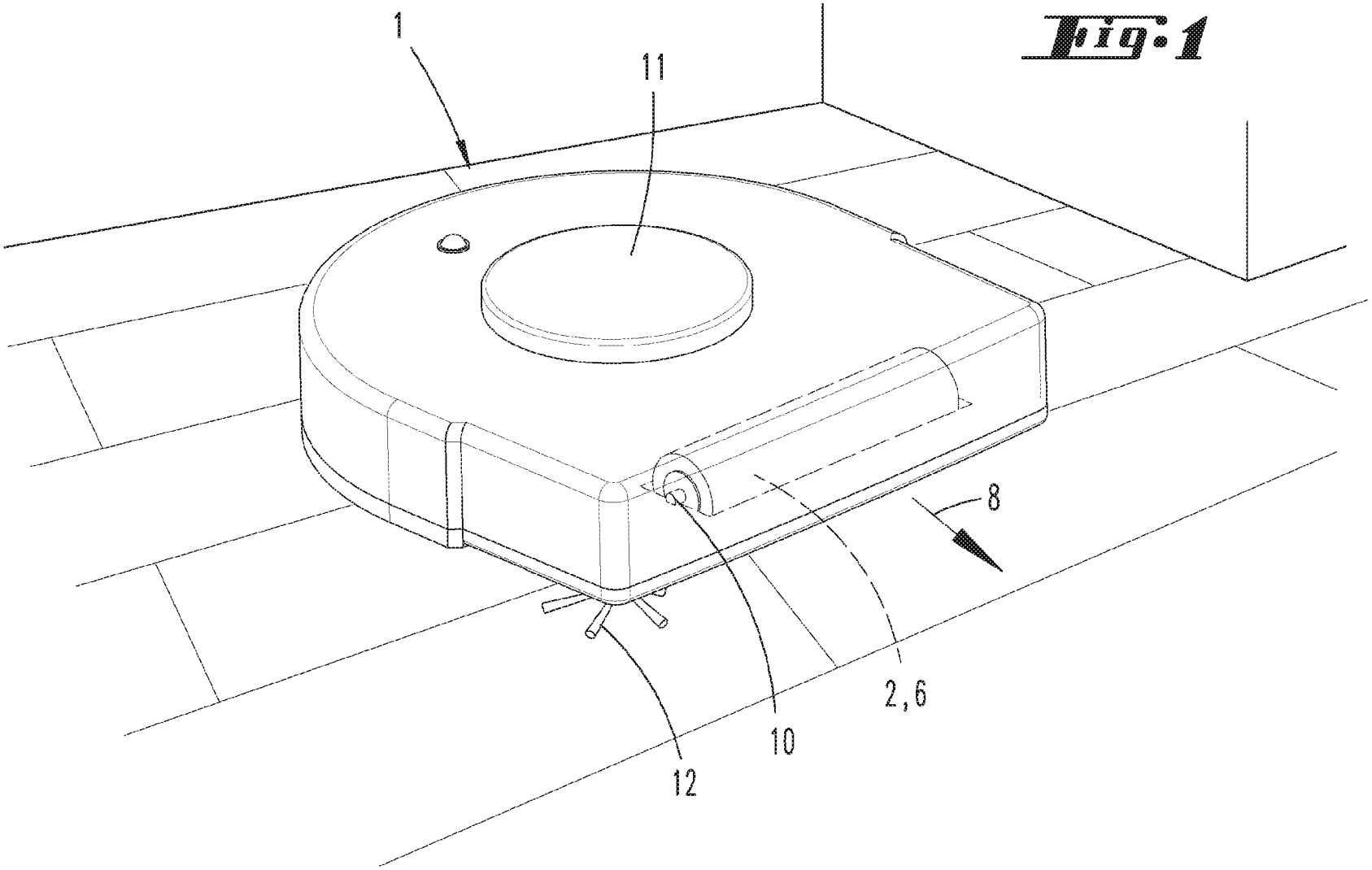
FIG. 1 is a perspective, external view of a floor treatment device according to the invention.

FIG. 1 shows a floor treatment device 1 according to the invention, which is here designed as a vacuuming robot. The floor treatment device 1 is positioned on a surface, e.g., here a wooden floorboard. The floor treatment device 1 is self-propelled, and has a navigation and self-localization device, which allows an orientation inside of premises. The floor treatment device 1 has two wheels 3, 4 (see FIG. 2) along with a floor treatment element 2, which here is designed like a brush roller. The floor treatment device 1 is supported against the surface to be cleaned by the two wheels 3, 4 on the one hand, and with a contact surface 13 of the floor treatment element 2 on the other, wherein both the wheels 3, 4 for moving the floor treatment device 1 and the floor treatment element 2 for cleaning purposes are motorized. The floor treatment device 1 has a main direction of movement 8, which is prescribed by the rotational plane of the wheels 3, 4. The floor treatment element 2 is arranged perpendicular to this main direction of movement 8, wherein the floor treatment element 2 rotates around a rotational axis 10.

The floor treatment device 1 further has an also motorized side brush 12, which is suitable in particular for cleaning room corners and room boundaries. In addition, the floor treatment device 1 has a distance measuring device 11, e.g., which is here designed as a triangulation measuring device arranged inside of the floor treatment device 1, and can measure distances from obstacles, preferably in an angular range of 360 degrees. The distance measuring device 11 is part of the navigation and self-localization device.

Figure 2:
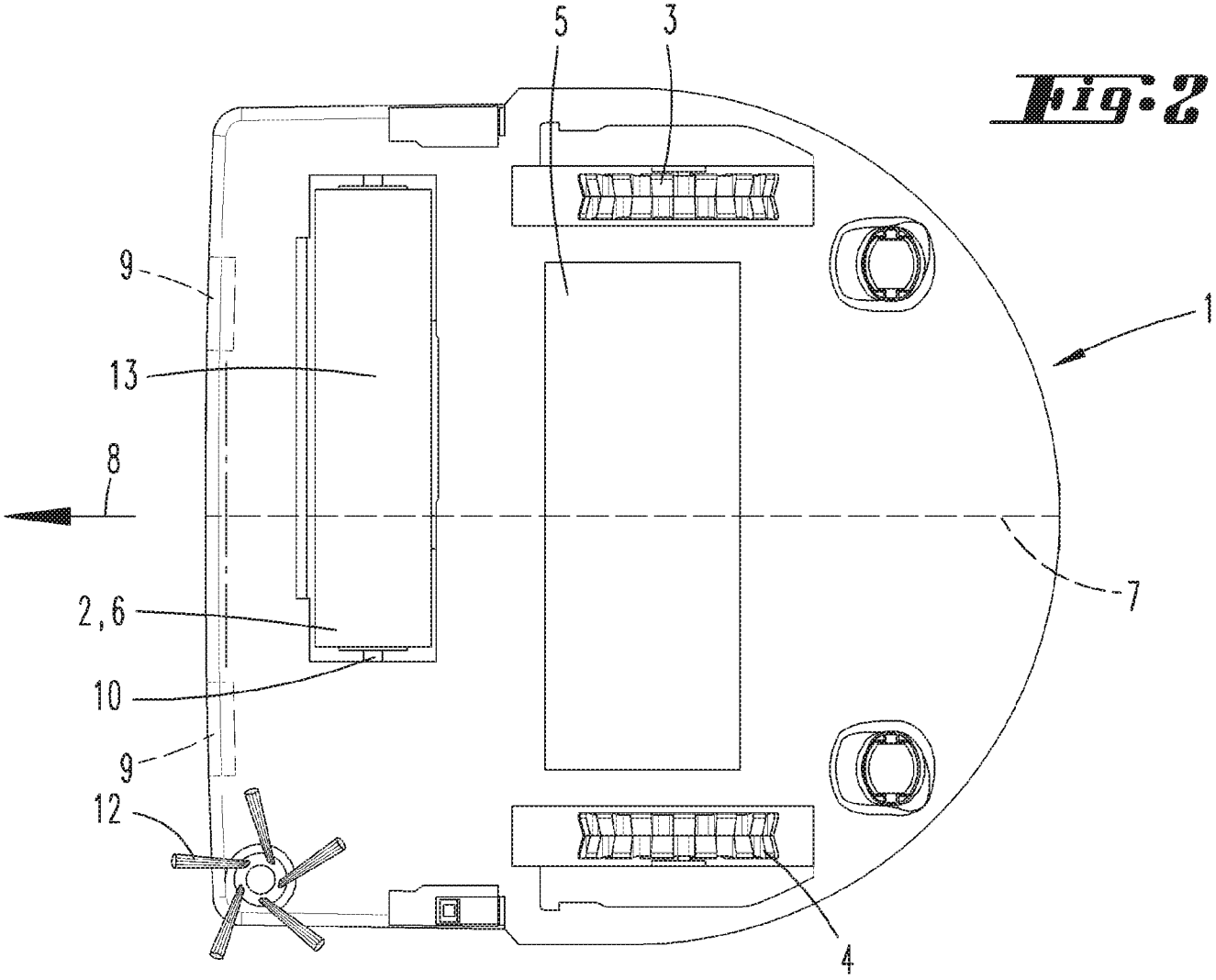
FIG. 2 is a bottom view of the floor treatment device.

FIG. 2 shows the floor treatment device 1 as viewed from below. Further evident here are two reflection measuring devices 9, which serve to measure the distance from a surface arranged underneath the floor treatment device 1. In particular, these reflection measuring devices 9 are suitable for preventing the floor treatment device 1 from falling into a precipice, for example on steps. The reflection measuring device 9 has a light source and a light receiver (neither shown), wherein the light source directs a beam of light onto a surface to be cleaned. This beam of light is first at least partially reflected or scattered on the surface, wherein a component usually gets back to the light receiver of the reflection measuring device 9 and can be evaluated for distance measurement purposes. The reflection measuring device 9 is further used to determine the floor type of the surface to be cleaned, since the floor type can also be inferred based on the reflectance of the surface, e.g., because a carpeted floor reflects less than a hard floor, such as a tile floor or wooden floor.

The floor treatment element 2, i.e., the bristle roller, is here simultaneously a frictional resistance element 6, which touches the surface to be treated with its contact surface 13 with the floor treatment device 1 set up on the surface to be cleaned. Depending on the floor type of the surface, e.g., carpeted floor or hard floor, the frictional resistance element 6 exerts more or less of a frictional force on the surface as the floor treatment device 1 moves. The frictional resistance element 6 is unsymmetrically arranged in relation to a reference axis of the floor treatment device 1. The reference axis 7 is oriented parallel to the main direction of movement 8 of the floor treatment device 1, and also centrally placed between the two wheels 3, 4 in relation to a direction perpendicular to the reference axis 7. As a result, the frictional resistance element 6 has more of an overhang and a larger portion of the contact surface 13 on one side of the reference axis 7 than on the opposite side. As the floor treatment device 1 moves over the surface, a force imbalance comes about in relation to the two half-sides of the floor treatment device 1, since a significantly higher frictional force acts on the half side of the floor treatment device having the wheel 3 than on the opposite side having the wheel 4. As a result, the floor treatment device 1 exits the main direction of movement 8 pursued previously toward the side having the larger portion of contact surface 13 to the surface to be treated. Here, this is the half side of the floor treatment device 1 on which the wheel 3 is arranged.

Figure 3:
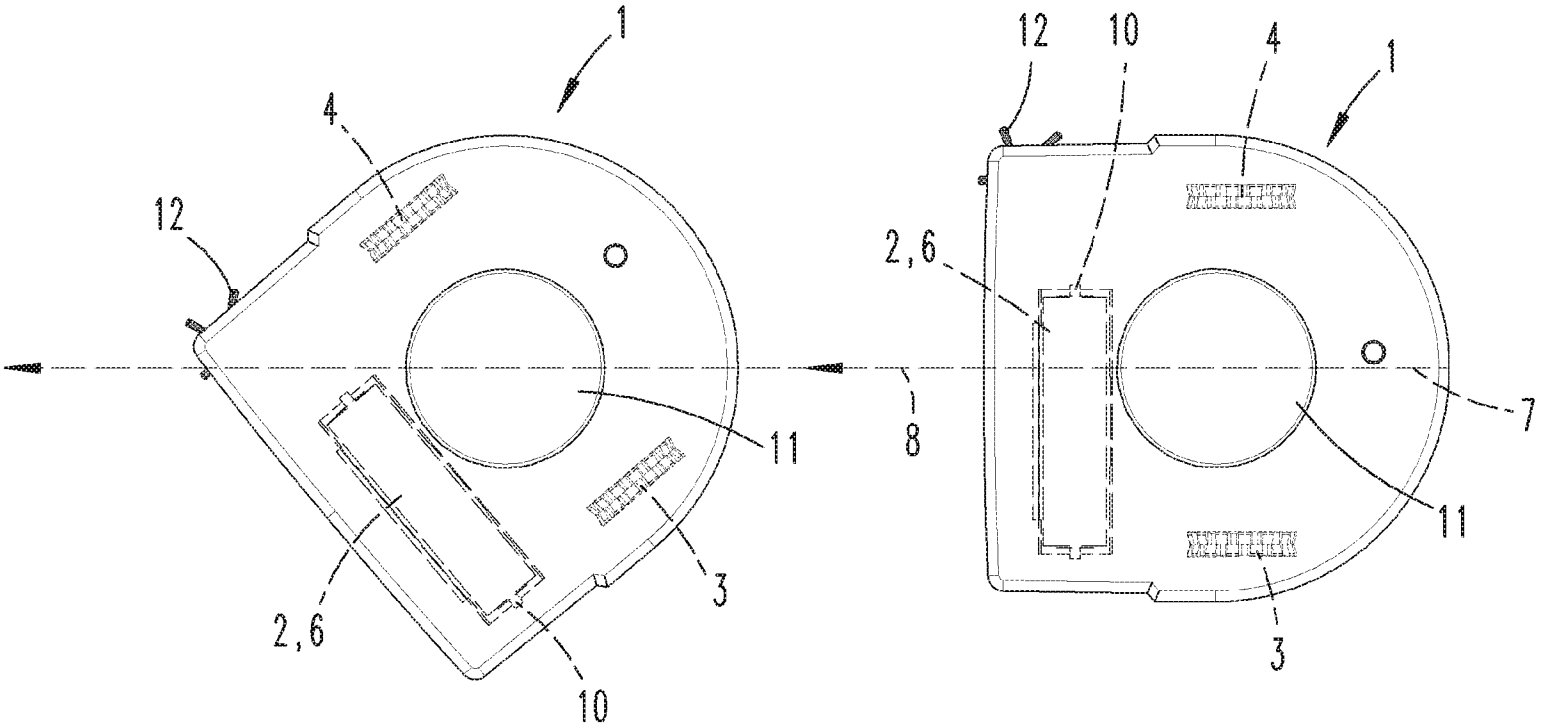
FIG. 3 is a drifting movement of the floor treatment device.

FIG. 3 shows how the floor treatment device drifts during a forward movement, which is caused by the unsymmetrical arrangement of the frictional resistance element 6. The floor treatment device 1 coming from the right and traveling in a main direction of movement 8 in the illustration according to FIG. 3 is pivoted to the left by the frictional force acting on the frictional resistance element 6, and thus exits the preceding main direction of movement 8. Exposure to the frictional force leads to a difference in speed of the driven wheels 3, 4, wherein the wheel 3 here has a lower resultant speed on the half side of the floor treatment device 1 with the higher portion of the frictional resistance element 6 than the other wheel 4. This difference in speed is calculated by a controller and evaluator 5 (see FIG. 2) of the floor treatment device 1, and compared with reference differences characteristic for specific floor types. For example, the reference differences can be stored in a memory of the floor treatment device 1, which the controller and evaluator 5 can access. In addition, it is also possible for the reference differences to be stored on a memory of an external server, and for the controller and evaluator 5 to access them through wireless communication. For example, the reference differences can also be indicated in the form of difference ranges, so that a correlation is detected if the calculated difference in speed falls within a specific difference range. Given a correlation, the floor type of the surface to be cleaned can be reliably determined.

Depending on whether the floor type is known, a targeted treatment of the surface to be treated can then be controlled. In particular, it is possible to specifically adjust the power of a suction fan of the floor treatment device 1, a speed of the floor treatment element 2 or the like. In addition, it is also possible to incorporate information about the position of specific floor types, e.g., carpeted floors, into an area map, for example which is accessed by the navigation system of the floor treatment device 1.

In order to even further increase the reliability of floor type determination, the supplemental use of additional methods for floor type determination can be provided. For example, the reflection measuring device 9 described above can be used for this purpose, which evaluates a reflection of the currently traversed surface and allocates it to known floor types. In addition, it is also possible to measure and evaluate the current consumption of a drive motor of the floor treatment element 2 and/or the side brush 12.

Even though the invention was here described in relation to a floor treatment device 1 designed as a vacuuming robot, the floor treatment device 1 can basically also be designed as a wiping robot, combined vacuuming-wiping device or the like. It is also possible that the floor treatment involve not just cleaning a surface, but other treatment tasks, such as polishing, grinding, lubricating and the like.

REFERENCE LIST

1 Floor treatment device
2 Floor treatment element
3 Wheel
4 Wheel
5 Controller and evaluator
6 Frictional resistance element
7 Reference axis
8 Main direction of movement
9 Reflection measuring device
10 Rotational axis
11 Distance measuring device
12 Side brush
13 Contact surface

The invention claimed is:

1. A self-propelled floor treatment device (1), in particular a cleaning robot, with a floor treatment element (2), at least two motorized wheels (3, 4) and a detection device for detecting a floor type of a surface to be treated, wherein the detection device has a frictional resistance element (6), which contacts the surface during a movement in such a way that a resultant force acts outside of a reference axis (7) on the floor treatment device (1), wherein the frictional resistance element (6) is arranged non-symmetrically to the reference axis (7) defined by a position of the wheels (3, 4) on the floor treatment device (1), and wherein the reference axis (7) is oriented parallel to a main direction of movement (8) of the floor treatment device (1) prescribed by the orientation of the wheels (3, 4), and aligned centrally between the wheels (3, 4) in relation to a direction perpendicular to the reference axis (7), and wherein the frictional resistance element is arranged such that the frictional resistance element (6) is exposed to the force, which because the frictional resistance is not centrally arranged relative to the wheels causes the floor treatment device to drift on the surface.

2. The floor treatment device (1) according to claim 1, wherein the frictional resistance element (6) is a treatment element (1) for treating the surface to be treated, in particular a cleaning roller that rotates perpendicular to the reference axis (7).

3. The floor treatment device (1) according to claim 1 wherein the frictional resistance element (6) is arranged perpendicular to the reference axis (7), and has a larger length on one side of the reference axis (7) than on the opposite side of the reference axis (7).

4. The floor treatment device (1) according to claim 1, comprising a controller and evaluator (5), which is set up to detect the floor type by comparing the speeds of the wheels (3, 4) at the same driving force and comparing a determined difference in speed with floor type-dependent reference differences.

5. The floor treatment device (1) according to claim 1, wherein the detection device has an ammeter allocated to a drive motor of the frictional resistance element (6), wherein a controller and evaluator (5) of the floor treatment device (1) is set up to compare a current received by the drive motor with floor type-dependent reference currents.

6. The floor treatment device (1) according to claim 1, wherein the detection device has an optical reflection measuring device (9) with a light source and a light receiver, wherein a light emission direction of the light source is essentially directed toward the ground plane spanned by the wheels (3, 4).

7. The floor treatment device (1) according to claim 6, wherein the reflection measuring device (9) is a distance measuring device, in particular a distance measuring device designed to detect precipices.

* * * * *